US008069669B2

(12) United States Patent
Pieussergues et al.

(10) Patent No.: US 8,069,669 B2
(45) Date of Patent: Dec. 6, 2011

(54) SEPARATOR FOR FEEDING COOLING AIR TO A TURBINE

(75) Inventors: Christophe Pieussergues, Nangis (FR); Denis Jean Maurice Sandelis, Nangis (FR)

(73) Assignee: Snecma, Paris (FR)

( * ) Notice: Subject to any disclaimer, the term of this patent is extended or adjusted under 35 U.S.C. 154(b) by 643 days.

(21) Appl. No.: 12/199,182

(22) Filed: Aug. 27, 2008

(65) Prior Publication Data

US 2009/0060723 A1 Mar. 5, 2009

(30) Foreign Application Priority Data

Aug. 31, 2007 (FR) ..... 0757283

(51) Int. Cl.
*F02G 3/00* (2006.01)

(52) U.S. Cl. ..... 60/752; 60/796

(58) Field of Classification Search ..... 60/752, 60/754, 755, 757, 758, 756, 759, 760, 796, 60/799, 800, 804
See application file for complete search history.

(56) References Cited

U.S. PATENT DOCUMENTS

| | | | | |
|---|---|---|---|---|
| 2,938,342 | A * | 5/1960 | Lombard et al. | 60/796 |
| 3,228,190 | A * | 1/1966 | Brown | 60/39.511 |
| 3,797,236 | A * | 3/1974 | Hooke et al. | 60/796 |
| 4,466,239 | A | 8/1984 | Napoli et al. | |
| H903 | H * | 4/1991 | Weinstein | 60/757 |
| 5,311,743 | A | 5/1994 | Ansart et al. | |
| 5,373,695 | A * | 12/1994 | Aigner et al. | 60/804 |
| 5,417,069 | A | 5/1995 | Alary et al. | |
| 5,528,896 | A | 6/1996 | Alary et al. | |
| 5,577,386 | A | 11/1996 | Alary et al. | |
| 5,592,821 | A | 1/1997 | Alary et al. | |
| 5,598,697 | A | 2/1997 | Ambrogi et al. | |
| 6,029,455 | A | 2/2000 | Sandelis | |
| 6,105,371 | A | 8/2000 | Ansart et al. | |
| 6,266,961 | B1 * | 7/2001 | Howell et al. | 60/752 |
| 6,543,233 | B2 * | 4/2003 | Young et al. | 60/757 |
| 6,988,369 | B2 | 1/2006 | Conete et al. | |
| 7,032,386 | B2 * | 4/2006 | Mandai et al. | 60/757 |
| 7,093,441 | B2 * | 8/2006 | Burd et al. | 60/752 |
| 7,197,882 | B2 | 4/2007 | Marnas et al. | |
| 2002/0172591 | A1 * | 11/2002 | Glynn et al. | 415/115 |
| 2006/0162336 | A1 | 7/2006 | Cayre et al. | |
| 2006/0242939 | A1 | 11/2006 | Pieussergues et al. | |
| 2007/0113556 | A1 | 5/2007 | Biebel et al. | |
| 2007/0180834 | A1 | 8/2007 | Caboche et al. | |
| 2008/0000447 | A1 | 1/2008 | Locatelli et al. | |
| 2008/0134661 | A1 | 6/2008 | Pieussergues et al. | |

FOREIGN PATENT DOCUMENTS

| | | |
|---|---|---|
| EP | 1 391 582 A2 | 2/2004 |
| EP | 1 818 612 A1 | 8/2007 |

* cited by examiner

*Primary Examiner* — William Rodriguez
*Assistant Examiner* — Lorne Meade
(74) *Attorney, Agent, or Firm* — Oblon, Spivak, McClelland, Maier & Neustadt, L.L.P.

(57) ABSTRACT

A combustion chamber which is fitted with a separator disposed between the radially inner wall of the chamber and the inner flange of the chamber is disclosed. The separator includes a tubular portion and a fastener portion. The tubular portion is centered on the main axis of the combustion chamber, with the upstream end thereof being situated upstream from orifices in the radially inner wall of the chamber. The fastener portion is secured to the combustion chamber. The tubular portion splits the flow of air running along the radially inner wall into an inner air flow passing between the tubular portion and the inner flange of the chamber, and an outer air flow passing between the radially inner wall and the tubular portion.

12 Claims, 3 Drawing Sheets

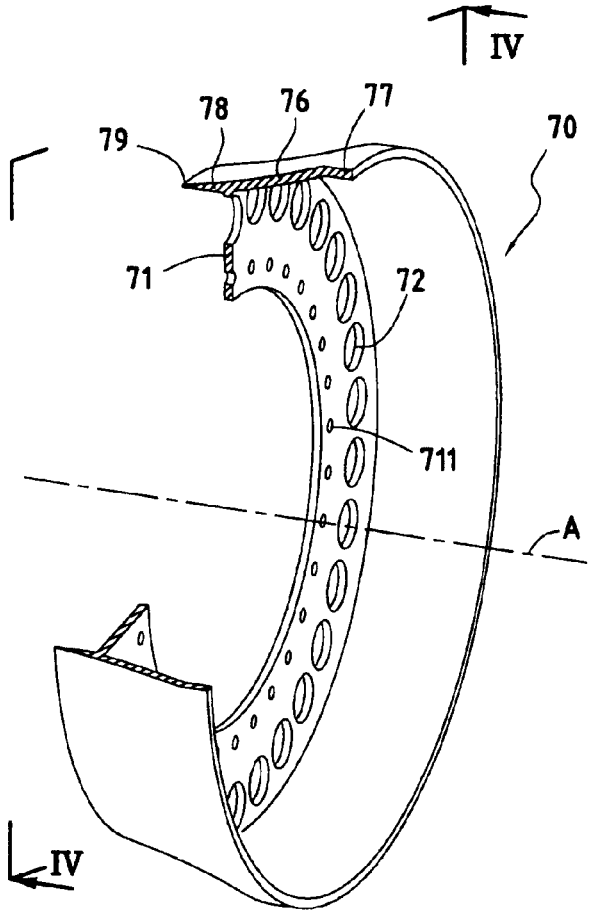
FIG.3
FIG.4A
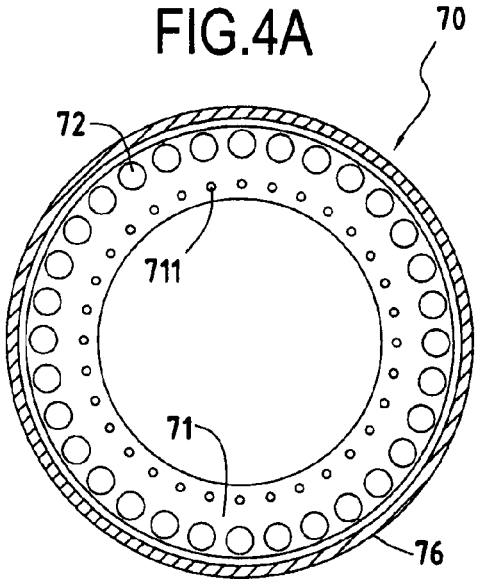
FIG.4B
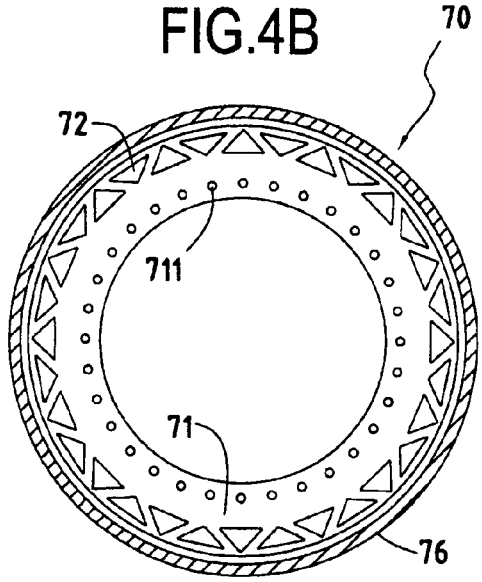

SEPARATOR FOR FEEDING COOLING AIR TO A TURBINE

The present invention relates to the field of annular combustion chambers.

In the description below, the terms "upstream" and "downstream" are defined relative to the normal flow direction of air along the outside of the annular wall of the combustion chamber. Terms such as "inner" and "outer" characterize a position that is closer to or further from the main axis of the combustion chamber, unless specified otherwise.

BACKGROUND OF THE INVENTION

Present turbomachines are provided with an annular combustion chamber having as its axis of symmetry the main axis of the turbomachine. One such chamber is shown in FIG. 5. The combustion chamber is typically defined by an end wall 12 including fuel injectors 13 and oxidizing air inlets, and by an annular wall 15 that extends in the longitudinal direction of the chamber 10 (thus corresponding to the upstream to downstream direction), substantially parallel to the main axis A of the turbomachine (not shown). The chamber 10 is closed at its upstream end by the end wall 12, and it is open at its downstream end 17 in the longitudinal direction to enable the burnt gases to be exhausted. This annular wall 15 is typically constituted by an annular inner shroud (a radially inner wall) 151 and by an annular outer shroud (radially outer wall) 152. The inner shroud 151 and the outer shroud 152 are coaxial about the main axis A of the turbomachine, the inner shroud 151 being closer to the main axis of the turbomachine than is the outer shroud 152, i.e. having a radius that is smaller than the radius of the outer shroud 152.

Upstream from the end wall 12, an upstream annular inner wall 11 of the chamber 10 extends the inner shroud 151 upstream.

The annular wall 15 is pierced over its entire area (or over a major fraction thereof) by a plurality of orifices of greater or smaller size, which orifices are to allow air to penetrate into the combustion chamber 10. The air that flows along the inner shroud 151 on the outside of the chamber 10, and that subsequently penetrates into said chamber via these orifices, flows between said inner shroud 151 and a wall referred to as the inner flange 21 of the chamber. This inner flange 21 that is annular and coaxial with the inner shroud 151 of the chamber, thus has a radius that is smaller than the radius of the inner shroud 151. The inner flange 21 is pierced by orifices, some of which (upstream orifices 215) are situated in its upstream portion, substantially facing the central portion of the inner shroud 151 of the chamber 10 (i.e. half way between the end wall 12 of the chamber 10 and the downstream end 217 of the inner flange 21). Thus, the air flowing along the inner shroud 151 passes in part via these upstream orifices 215. Once it has passed through these upstream orifices, this air cools the high-pressure (HP) turbine wheel that is situated downstream therefrom.

Because of this disposition of the inner wall of the combustion chamber and because of the orifices in the inner flange, the flow of air for passing through the orifices in the inner flange in order to cool the HP turbine wheel is subjected to the influence of the combustion chamber. Before passing through these orifices, this air is in contact with the inner wall, which is hot and which is also pierced by air inlet orifices, and this air is thus subjected to heating by convection. This air is also subjected to heating by radiation through these orifices in the chamber, the radiation coming from the flames of the combustion. In addition, the instabilities of the combustion generate turbulence in the flow of air, through the orifices in the chamber, which turbulence can contribute to disturbing the feed of cooling air to the HP wheel.

Overall, this air is thus subjected to heating that is harmful since the function of the air is to cool the HP turbine wheel.

OBJECTS AND BRIEF SUMMARY OF THE INVENTION

The invention seeks to provide a device that reduces the heating of the air for cooling the HP turbine wheel, and to reduce the disturbance caused to this air by combustion instabilities propagating from the combustion chamber.

This object is achieved by the fact that the combustion chamber is fitted with a separator disposed between the radially inner wall of said chamber and the inner flange of said chamber, said separator comprising both a tubular portion and a fastener portion, the tubular portion being centered on the main axis of said combustion chamber and having an upstream end that is situated upstream from orifices in said radially inner wall of the chamber, and the fastener portion being secured to said combustion chamber, said tubular portion acting at its upstream end to split the flowsection situated between said radially inner wall of the chamber and said inner flange into an inner annular flowsection and an outer annular flowsection such that the flow of air passing along the radially inner wall is split into an inner air flow passing between said tubular portion and the outer flange of said chamber, and an outer air flow passing between said radially inner wall and said tubular portion.

By means of these dispositions, the inner air flow that is for cooling the HP turbine wheel is no longer heated by convection and radiation from the wall of the chamber or by radiation from the flame, and it is no longer disturbed by combustion instabilities coming through the orifices of the inner wall of the combustion chamber. The undesirable interaction between the combustion chamber and the flow of air for cooling the HP turbine wheel is thus greatly diminished, or even eliminated.

Advantageously, the fastener portion is a radial portion that extends from the tubular portion towards the main axis, and it is pierced by main holes for passing the air from upstream to downstream.

The separator is thus not fastened directly to the (hot) wall of the chamber, and it is thus not heated by solid conduction from the chamber. This disposition is advantageous since the separator needs to be as cool as possible in order to avoid heating the inner air flow.

BRIEF DESCRIPTION OF THE DRAWINGS

The invention can be well understood and its advantages appear more clearly on reading the following detailed description of an embodiment given by way of nonlimiting example. The description refers to the accompanying drawings, in which:

FIG. 3 is a perspective view partially in section showing a separator of the invention;

FIG. 4A is a cross-section view on line IV-IV of FIG. 3, showing a separator of the invention;

FIG. 4B is a cross-section view of another embodiment of a separator of the invention.

MORE DETAILED DESCRIPTION

Figure 1:
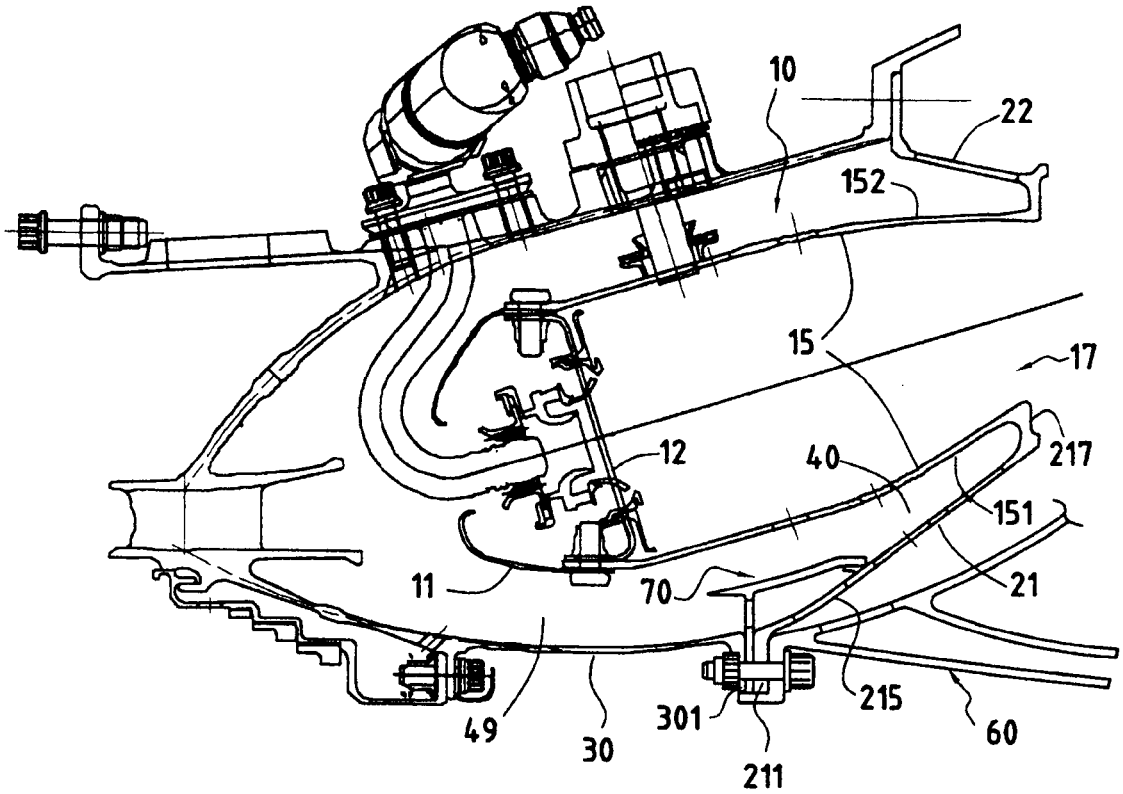
FIG. 1 is a longitudinal view of a turbomachine combustion chamber showing a separator of the invention.
Figure 5:
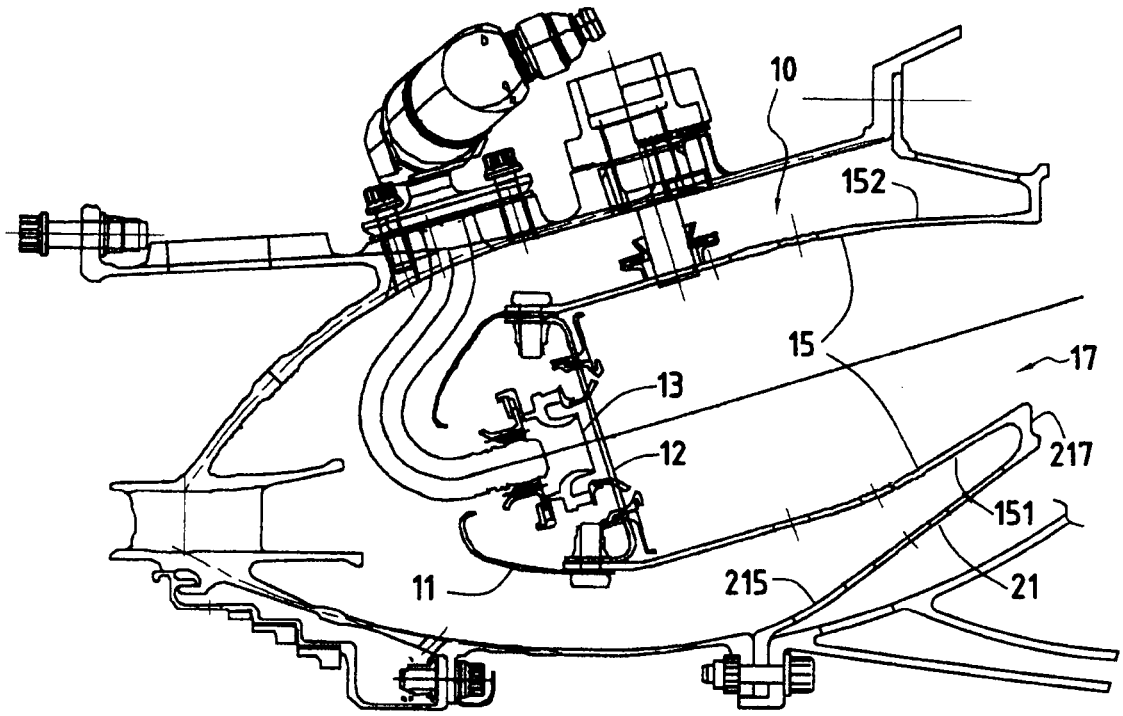
FIG.5 PRIOR ART
FIG. 5 is a longitudinal view of a prior art turbomachine combustion chamber.

FIG. 1 shows a combustion chamber 10 of a turbomachine together with structures adjacent thereto. Ignoring elements of the invention, this chamber is identical to the above-described prior art chamber (FIG. 5). Portions that are common to FIG. 1 and to FIG. 5 are consequently given the same reference numerals, and they are not described again. The downstream end of the outer shroud 152 is extended radially outwards by an annular outer flange 22, and the downstream end of the inner shroud 151 is extended radially inwards by an annular inner flange 21. These flanges are thus secured to the chamber 10. The outer flange 22 and the inner flange 21 are attached to a casing wall 30 that surrounds the chamber 10, and they thus serve to fasten the chamber to the casing, which casing is secured to the turbomachine.

The inner flange 21 extends the downstream end of the inner shroud 151 inwards and then upstream, such that the inner flange 21, which is coaxial with the inner shroud 151, has a radius that is smaller than the radius of the inner shroud 151. The inner flange 21 thus co-operates with the inner shroud 151 to define a downstream annular flowsection 40.

The upstream end 211 of the inner flange 21 is radial and is fastened (e.g. by a plurality of nuts and bolts distributed circumferentially along said upstream end 211), to a radial downstream end 301 of the casing wall 30. The casing wall 30 extends the inner flange 21 upstream, thereby co-operating with the upstream annular inner wall 11 of the chamber 10 to define an upstream annular flowsection 49 (that extends downstream via the downstream annular flowsection 40).

The upstream end 211 of the inner flange 21 is situated longitudinally substantially at the same level as the upstream portion of the inner shroud 151 (that terminates upstream approximately level with the end wall 12 of the chamber). In the example shown in the figures, this upstream end 211 is situated longitudinally substantially in the upstream first quarter of the length between the end wall 12 and the downstream end 217 of the inner flange 21 (this downstream end 217 being situated at the downstream end 17 of the chamber 10).

Typically, the downstream annular flowsection 40 tapers from upstream to downstream, such that the radial size of the downstream annular flowsection 40 level with the upstream end 211 of the inner flange 21 is greater than the radial dimension of the annular flowsection 40 level with the downstream end 217 of the inner flange 21.

As explained above, the inner flange 21 is pierced by orifices, including upstream orifices 215. The fraction of the air coming from the upstream annular flowsection 49 that passes through these upstream orifices 215 of the inner flange 21 serves to cool the HP turbine wheel (not shown). In FIG. 1, after passing through the upstream orifices 215, this air passes through a structure 60 prior to cooling the turbine.

Figure 2:
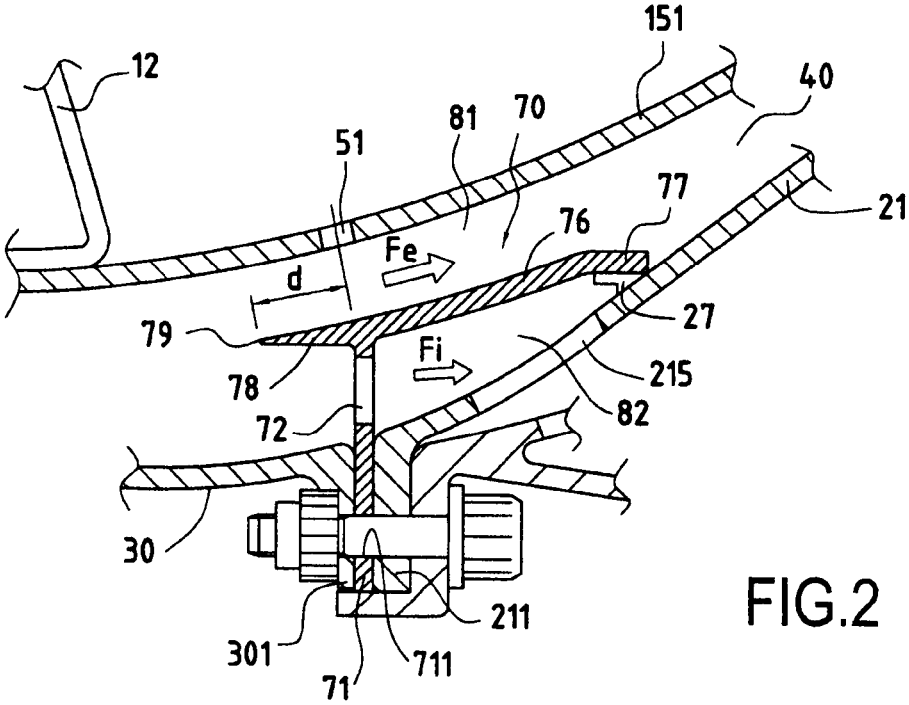
FIG. 2 is a longitudinal section view of a separator of the invention showing how it is fastened to the turbomachine.

According to the invention, a separator 70 is placed in the downstream annular flowsection 40, i.e. between the inner shroud 151 and the assembly constituted by the inner flange 21 and the casing wall 30. As shown in FIGS. 2 and 3, the separator 70 comprises a tubular portion 76 centered on the main axis A of the combustion chamber 10, and a radial portion 71 extending radially from the tubular portion 76 towards the main axis A, and pierced by main holes 72 that are oriented parallel to the main axis A.

For example, the radial portion 71 of the separator 70 is connected to the tubular portion 76 of the separator 70 in the upstream half of said tubular portion 76. For example, the radial portion 71 is connected to the tubular portion 76 in the upstream first quarter or in the upstream first third of the tubular portion 76.

Thus, as shown in FIG. 2, the tubular portion 76 of the separator 70 acts from its upstream end 79 to split the downstream annular flowsection 40 into two halves in the upstream to downstream direction, firstly into an outer annular flowsection 81 situated between the inner shroud 151 of the chamber 10 and said tubular portion 76, and secondly into an inner annular flowsection 82 situated between the tubular portion 76 and the assembly constituted by the inner flange 21 and by the casing wall 30. More precisely, the fraction 78 of the tubular portion 76 that is situated upstream from the radial portion 71 of the separator 70 lies between the casing wall 30 and the inner shroud 151.

The radial portion 71 of the separator 70 is thus situated at the interface between the casing wall 30 and the inner flange 21. The separator 70 is fastened to the inner flange 21 via the radially inner end of its radial portion 71.

For example, the radially inner end of the radial portion 71 is pierced by fastener holes 711 suitable for receiving a fastener device for fastening said radial portion 71 to said inner flange 21. For example, fastening can be performed by bolting. Thus, the radially inner end of the radial portion 71 is sandwiched between the radial upstream end 211 of the inner flange 21 and the radial downstream end of the 301 of the casing wall 30. The bolts that hold this upstream end 211 and the downstream end 301 together pass through the fastener holes 711, with the assembly that is constituted by the upstream end 211, the inner end of the radial portion 71, and the downstream end 301 being clamped by nuts tightened onto the bolts. The separator 70 is thus firmly held in position in the downstream annular flowsection 40.

As described above, the tubular portion 76 of the separator 70 splits the downstream annular flowsection 40 in the upstream to downstream direction into an inner annular flowsection 82 and an outer annular flowsection 81 situated between the inner shroud 151 of the chamber 10 and said tubular portion 76. The tubular portion 76 does not have holes, since its function is to separate the air flowing in the outer annular flowsection 81 (as heated by the chamber 10) from the air flowing in the inner annular flowsection 82. Thus, the tubular portion 76 constitutes a screen between the air flowing in the inner annular flowsection 82 and the chamber 10.

The air coming from the upstream annular flowsection 49 is thus split within the downstream annular flowsection 40 at the upstream end 79 of the tubular portion 76 of the separator 70 into an outer air flow $F_e$ passing through the outer annular flowsection 81, and into an inner air flow $F_i$ passing through the inner annular flowsection 82 (these flows being represented by arrows in FIG. 2).

Thus, the (radial) cross-section of the outer annular flowsection 81 is smaller than the cross-section of the downstream annular flowsection 40 in the absence of the separator 70. Furthermore, the tubular portion 76 of the separator 70, and in particular its portion fraction 78 situated upstream from the radial portion 71 of the separator, is substantially parallel to the inner shroud 151 of the combustion chamber 10. The outer annular flowsection 81 is thus of substantially constant cross-section, which would not be so in the absence of the separator 70, given that the inner flange 21 comes towards the inner shroud 151 on going from upstream to downstream.

This characteristic of the outer annular flowsection 81 (substantially constant cross-section) leads to a better flow of air, and thus to an increase in the Mach number in the outer annular flowsection 81. This increase in the Mach number provides better cooling by convection for the inner shroud 151 of the chamber 10. Tests performed by inventors show that the increase in the Mach number is of the order of 10% to 20%.

On penetrating into the inner flowsection 82, the inner airflow $F_i$ flows between the casing wall 30 and the inner shroud 151. It then passes through the main holes 72 of the radial portion 71 of the separator 70 and penetrates into the portion of the inner flowsection 82 that is defined between the inner flange 21 and the inner shroud 151. At the downstream end 77 of its tubular portion 76, the separator 70 is in contact with the inner flange 21, such that the downstream end of the inner annular flowsection 82 is closed. For example, the downstream end 77 is in contact with a portion 27 of the inner flange 21 that constitutes an annular projection, as shown in FIG. 2.

As mentioned above, the inner flange 21 presents upstream orifices 215 in its upstream portion. These upstream orifices 215 are situated between the portion 27 and the upstream end 211 of the inner flange 21. The inner flow of air $F_i$ must therefore pass through the upstream orifices 215 of the inner flange 21 in order to leave the inner annular flowsection 82. Thereafter, this inner air flow $F_i$ flows towards the HP turbine wheel that it is to cool.

It is possible for the downstream end 77 of the separator 70 merely to be slid over the portion 27 of the inner flange 21, thereby helping in centering the separator 70 on the inner flange 21.

Alternatively, the downstream end 77 of the separator 70 can be fastened to the portion 27 of the inner flange 21, e.g. by brazing. This fastening is preferably not done by bolting, thereby making it easier to assemble the separator 70 on the inner flange 21. The separator 70 is thus fastened to the inner flange 21 both via the radially inner end of its radial portion 71 and via the downstream end 77 of its tubular portion 76. Fastening the separator 70 twice in this way secures it better to the inner flange 21. Furthermore, since the radial portion 71 of the separator 70 is connected to the tubular portion 76 of the separator 70 in the upstream half of said tubular portion 76, the separator 70 is fastened to the inner flange 21 via both its upstream and downstream ends, thereby improving the stability with which the separator 70 is positioned, and stiffening the structure.

More generally, instead of the radial portion 71, the separator 70 could have a fastener portion that is secured to the combustion chamber 10.

For example, the separator 70 could be rigidly fastened (e.g. by welding) via the downstream end 77 of its tubular portion 76 to the inner flange 21 (e.g. onto the portion 27 of the inner flange 21). Under such circumstances, the separator 70 would have only the tubular portion 76 and would not include the radial portion 71, and the downstream end 77 would become the fastening portion. Such a solution presents the advantage that the inner airflow $F_i$ flows in the inner annular flowsection 82 without obstacle (since there is no longer any radial portion to pass through).

Alternatively, the fastener portion could connect to the tubular portion 76 in the upstream half of said tubular portion 76.

The upstream end 79 of the tubular portion 76 of the separator is situated upstream from the orifices of the inner shroud 151 of the chamber 10. This situation is shown in FIG. 2, where the upstream end 79 is at a distance d upstream from the orifice 51 of the inner shroud 151 that is situated furthest upstream. By way of example, this distance d lies in the range 15 millimeters (mm) to 20 mm.

It can thus be understood that the inner air flow $F_i$ is completely separated from the inner shroud 151 of the chamber 10 by the tubular portion 76 of the separator 70. As a result, the inner airflow $F_i$ does not come into contact with the inner shroud 151 so it is not heated by convection, nor is it heated by radiation from the flame passing through the orifices in the inner shroud 151, nor is it disturbed by combustion instabilities passing through these orifices. The inner air flow $F_i$ can thus be more effective in cooling the HP turbine.

Furthermore, the leading edge of the upstream end 79 of the tubular portion 76 of the separator 70 can be rounded, thereby improving the flow both of the outer air flow $F_e$ that is to pass along the chamber 10 and of the inner airflow $F_i$ that is to cool the HP turbine wheel.

As mentioned above, the radial portion 71 of the separator presents main holes 72 for passing the inner air flow $F_i$. These main holes 72 are situated close to the tubular portion 76, between this tubular portion 76 and a location where the radial portion 71 meets the inner flange 21.

By way of example, these main holes 72 are distributed over the entire circumference of the radial portion 71. For example they may be circular, as shown in FIG. 4A, or triangular, being disposed in a staggered configuration (i.e. any two adjacent triangles form a lozenge), as shown in FIG. 4B.

These main holes 72 occupy the greatest possible area in the effective cross-section of the radial portion 71 so as to reduce head losses in the flow of air through these main holes 72, while still allowing the separator 70 to retain properties of sufficient mechanical strength. The effective section of the radial portion 71 is defined as being the region of this radial portion that is subjected to the inner air flow $F_i$. This effective section is thus the annular region extending between the location where the radial portion 71 joins the tubular portion 76 (this location is substantially a circle in examples shown in the figures), and the location where the radial portion 71 comes into contact with the inner flange 21 (this location is substantially a circle in the examples shown in the figures). For example, the area of the main holes 72 occupies 60% to 80% of the effective section of the radial portion 71.

The material of the separator is suitable for withstanding temperatures of up to 550° C. By way of example, this material may be a steel based on nickel/chromium.

The above described combustion chamber is a chamber for a turbomachine. The chamber could also constitute any combustion chamber.

What is claimed is:

1. An annular combustion chamber comprising:

a radially inner wall;

an inner flange; and a separator disposed between the radially inner wall and the inner flange, said separator including a tubular portion and a fastener portion, the tubular portion being centered on a main axis of said combustion chamber and having an upstream end that is situated upstream from orifices in said radially inner wall of the chamber, and the fastener portion being secured to said combustion chamber, wherein said inner flange extends from a downstream part of the radially inner wall inwards towards the main axis and then upstream such that said inner flange is coaxial with the radially inner wall, and a radius of said inner flange is smaller than a radius of the radially inner wall, and wherein said upstream end of said tubular portion splits a flowsection situated between said radially inner wall of the chamber and said inner flange into an inner annular flowsection and an outer annular flowsection such that the flow of air passing along the radially inner wall is split into an inner air flow passing between said tubular portion and said inner flange of said chamber, and an outer air flow passing between said radially inner wall and said tubular portion, and wherein said tubular portion is substantially parallel to said radially inner wall of said chamber such that said outer annular flowsection is of substantially constant cross-section.

2. A combustion chamber according to claim 1, wherein said fastener portion is a downstream end of the tubular portion, said downstream end being rigidly fastened to said inner flange.

3. A combustion chamber according to claim 1, wherein said fastener portion is a radial portion that extends from said tubular portion towards said main axis, and in that said fastener portion is pierced by main holes for passing the air of said inner air flow from upstream to downstream.

4. A combustion chamber according to claim 3, wherein said separator is fastened to said inner flange by a radially inner end of said radial portion.

5. A combustion chamber according to claim 4, wherein the radially inner end of said radial portion is pierced by holes suitable for receiving a fastener device for fastening said radial portion on said inner flange.

6. A combustion chamber according to claim 3, wherein said separator is in contact with said inner flange via a downstream end of said tubular portion.

7. A combustion chamber according to claim 3, wherein the area of said main holes occupies 60% to 80% of the area of an effective section of said radial portion.

8. A combustion chamber according to claim 3, wherein said main holes are distributed over the entire circumference of said radial portion.

9. A combustion chamber according to claim 1, wherein said fastener portion of the separator is connected to said tubular portion in the upstream half of said tubular portion.

10. A combustion chamber according to claim 1, wherein a leading edge of said upstream end of the tubular portion is rounded.

11. A turbomachine provided with said combustion chamber according to claim 1.

12. A combustion chamber according to claim 2, wherein said downstream end of the tubular portion is brazed to said inner flange.

* * * * *